United States Patent [19]

Podella et al.

[11] 4,013,595

[45] Mar. 22, 1977

[54] NON-FLAMMABLE RUG CLEANING COMPOSITION

[75] Inventors: Carl Walter Podella, Kenosha; Fred Jay Reichley, Racine, both of Wis.

[73] Assignee: S. C. Johnson & Son, Inc., Racine, Wis.

[22] Filed: May 23, 1975

[21] Appl. No.: 580,495

[52] U.S. Cl. ..... 252/545; 252/8.1; 252/89 R; 252/305; 252/550; 252/DIG. 2

[51] Int. Cl.[2] ..... C11D 3/37; C11D 3/20; C11D 1/14

[58] Field of Search ..... 252/89, 545, 550, 305, 252/8.1, DIG. 2

[56] References Cited

UNITED STATES PATENTS

| | | | |
|---|---|---|---|
| 3,736,259 | 5/1973 | Buck et al. | 252/89 |
| 3,835,071 | 9/1974 | Allen et al. | 252/545 |

*Primary Examiner*—Harris A. Pitlick

[57] ABSTRACT

A non-flammable rug cleaning composition utilizing flammable hydrocarbons as a propellant is obtained by the incorporation of at least 0.3 by weight of lauryl alcohol into the composition which includes from 0.5 to 5% by weight of $CH_3(CH_2)_{10}CH_2OSO_3M$ where M is a positively charged cation.

13 Claims, No Drawings

NON-FLAMMABLE RUG CLEANING COMPOSITION

BACKGROUND OF THE INVENTION

This invention relates to substantially non-flammable aerosol rug cleaning compositions. More particularly, this invention relates to an improved rug cleaning composition which has a low degree of flammability while utilizing flammable hydrocarbons as propellant.

Although hydrocarbon propellants have long been used as propellants for aerosol rug cleaning compositions, the problem of the flammability of these resultant compositions has not been particularly great in the past. However, with the advent of the non-scrubbing or no-work aerosol rug cleaning compositions, the flammability of the product has become a concern. This is because with a conventional rug cleaning composition a small section of the carpet is sprayed. At this time, the spraying is stopped and the composition is worked into the carpet by means of a sponge mop or similar apparatus. This sufficiently dissipates the flammable hydrocarbon propellant so that substantially no flammability problem results. However, the non-scrubbing or no-work type of formulations typified by "Spray 'N Vac" marketed by Unilever or compositions disclosed in co-pending application Ser. No. 510,871, filed Oct. 1, 1974, to Anderle and Schwarz, may present a flammability hazard. These products are applied to the entire surface area of the carpet and, unless the resultant flammability of the foam dispensed from the container is controlled, the accidental dropping of a match or ignition of a section of the foam can cause flame propagation across the carpet. This danger is especially aggravated since many of the synthetic carpet materials, such as acrylic type carpets, are also sufficiently flammable so as to support flame.

BRIEF DESCRIPTION OF THE INVENTION

Surprisingly, it has been found that, by incorporating a small percentage of lauryl alcohol into a carpet cleaning composition utilizing flammable hydrocarbons as propellant, the flammability of these compositions is sufficiently reduced so as to render the foams dispensed from these compositions substantially non-flammable. This result is particularly surprising in view of the fact that other alcohols, such as the C10, C14, C16, etc. alcohols normally utilized in aerosol rug cleaning compositions do not provide this reduction in flammability.

Accordingly, it is a primary object of the present invention to provide an aerosol rug cleaning composition which is substantially non-flammable when applied as a foam to carpeting.

It is a further object of the present invention to provide non-flammable compositions having desirable foam characteristics.

Other objects and advantages of the present invention will become more apparent from the following, more detailed description thereof.

DETAILED DESCRIPTION

The present invention is directed to improved aerosol rug cleaning compositions, particularly those of the type to be applied continuously to clean and/or condition carpets without intermittently stopping to scrub and break down the foam comprising from 2 to 20% by weight of a rug cleaning polymer, 0 to 5% of a metal salt, 0.5 to 10% by weight of at least one surface active agent, 50 to 90% by weight water and 5 to 20% by weight hydrocarbon propellant, the improvement which comprises incorporating at least 0.3% by weight of lauryl alcohol and wherein said surfactant includes from 0.3 to 10% by weight of $CH_3(CH_2)_{10}CH_2OSO_3M$ wherein M is a positively charged cation.

It has been found that the incorporation of lauryl alcohol at least 0.3% by weight and preferably from 0.3 to 5% by weight and most preferably 0.4 to 2% by weight substantially pure, i.e., approximately 95% or higher purity, lauryl alcohol substantially retards the flammability of carpet cleaning foams containing $CH_3(CH_2)_{10}CH_2OSO_3M$ and dispensed utilizing a hydrocarbon propellant. It is particularly preferred to use substantially pure lauryl alcohol. However, less pure grades of lauryl alcohol can be used since the other fatty alcohols, such as cetyl alcohol, which might be present in impure grades also have found utility in carpet care products. In this regard, if a less pure grade of lauryl alcohol is utilized, the amount of lauryl alcohol incorporated into the composition should be increased as the purity is decreased. There really appears to be no operative upper limit. However, no benefit is derived from using more than 5% lauryl alcohol. Therefore, this represents an economic upper limit while the flammability decreases in marginally as the lauryl alcohol is increased above 2%.

As propellants which are suitable for dispensing this type of composition, isobutane, normal butane and propane as well as mixtures are particularly suitable. These hydrocarbons are present in conventional amounts ranging from 5 to 20% by weight and preferably 5 to 10% by weight. These hydrocarbon materials are particularly flammable, and it is often difficult to control the flammability by the incorporation of various amounts of fluorinated hydrocarbons and other agents because, even though the composition as dispensed will not be flammable, if the flammability reducing agent is more or less volatile than the hydrocarbon, the flammability reducing agent and/or the hydrocarbon will preferentially be released from the foam, thereby removing the protective flammability of the halogenated hydrocarbon propellants. Further, more other flame retardant compounds can adversely effect the product's performance. Lastly, in view of the current ecological concern relating to Freon-type propellants, it is now desirable to formulate products not utilizing these materials.

With regard to the polymeric component of the rug cleaning compositions of the present invention, a number of materials can be utilized, such as the styrene maleic anhydride and related resins as disclosed in U.S. Pat. No. 3,835,071, incorporated herein by reference. In addition to these compositions, resins as disclosed in U.S. Pat. Nos. 3,723,358 and 3,723,357 also can be used, the disclosure of which is incorporated by reference as well as those in copending Ser. No. 510,871, filed Oct. 1, 1974, the disclosure of which is incorporated by reference. Additional other compositions which are useful include various acrylate copolymers and terpolymers, such as methyl methacrylate-methacrylic acid copolymers, styrene-methacrylic acid copolymers, styrene-methyl methacrylate-methacrylic acid terpolymers and the like. These polymers are the primary cleaning agent in these compositions and comprise from 2 to 20% and preferably from 2 to 10% by weight of the composition.

Occasionally, in this type of composition, it is also desirable to add a metal salt, either in the form of a common salt or a complex metal salt, so as to further embrittle the polymer or resin component to aid in removal. Salts often used of this type are the complex ammonium salts, such as zinc ammonium carbonate, zinc ammonium citrate, zinc ammonium acetate, zirconium ammonium carbonate, aluminum ammonium carbonate, and the like. The salts are present in amounts ranging from 0 to 5% by weight and preferably from 0.5 to 3% by weight.

The rug cleaning composition must also include from 0.3 to 10% by weight and preferably from 0.5 to 3% by weight of $CH_3(CH_2)_{10}CH_2OSO_3M$ wherein M is a cation. All substantially water soluble salts of lauryl sulfate co-act with the lauryl alcohol to retard flammmability. Preferred salts are the sodium, potassium, lithium, magnesium, ammonium, monoethanolamine, diethanolamine and triethanolamine salts, while the most preferred are the sodium, magnesium and ammonium salts.

Other surfactants useful in the compositions of the present invention when mixed with a substantial percentage, i.e., 50% or more, of lauryl sulfates also are conventional surfactants utilized in carpet cleaning compositions and include surfactants such as sodium lauryl succinoate, the sarcosinates, the sulfosuccinates etc. The disclosure of U.S. Pat. No. 3,835,071, columns 3–5, as it relates to various surface active agents useful in rug cleaning compositions is hereby incorporated by reference. The surfactants are the secondary cleaners and provide a visible spray and foam. The total surfactant content, including the lauryl sulfates, comprises from 0.5 to 10% by weight and preferably from 1 to 5% by weight of the composition with the weight percentage of lauryl sulfate to surfactant total being from 30% to 100% and preferably from 50 to 100% .*

*The lauryl sulfate percentage should be above 50% except if the lauryl sulfate is combined with a sulfosuccinate. In this case the percentage can be reduced to 30% without making the composition flammable.

The other components of the composition include water, i.e., 50 to 95% and perferably 67% to 95%, which comprises the primary portion of the composition as well as small amounts, i.e., up to 5% by weight, of other conventional additives, such as preservatives, corrosion inhibitors, optical brighteners, perfumes and the like.

The foams of the present invention are substantially non-flammable, i.e., considerably less flammable than similar compositions not including the lauryl alcohol. At present there are three test methods in use to measure the relative flammability of aerosol foams. The two methods which are described in a July 7, 1969, tentative method of the CSMA included with CSMA Bulletin 247–69 are the "Tower" method and the "Trough" method.

For the Tower method a cup of foam from a new and partially used package, i.e., 20% remaining, is placed inside a metal chimney having 15 evenly spaced holes covered with tape. After 5 minutes, the holes are sequentially opened from the top down by removing the tape and touching a gas burner to each hole. A positive result is a flash wihtin the tube, the lower the hole before a positive result, the less flammable the composition.

The Trough method uses a metal 14 inch trough which is filled with foam from new and partially emptied containers. The test is run immediately after the trough is filled, again 2 minutes later and then 5 minutes after filling. A gas burner is brought in contact with the foam at one end with a positive result being flame propagation or a sustained flame after the burner is removed. Again, this test is relative and a foam which propagates flame 2 inches is less flammable than one which travels the length of the trough.

The last test method is an in-use test method. A square of plush acrylic carpet 1 × 1 foot is sprayed with foam to build up a foam ¾ to 1 inch thick. A lit match is touched to the foam within 10 seconds. A flash or flame propagation indicates a positive result.

The compositions of the present invention will now be illustrated by way of the following examples wherein all parts and percentages are by weight:

EXAMPLE 1

The following formulation was prepared:

| | |
|---|---|
| Styrene maleic anhydride resin (40%) | 12.5% |
| Zinc ammonium citrate (61.2%) | 4.5 |
| Ammonium lauryl sulfate (30%) | 3.86 |
| Preservatives | 0.7 |
| Perfume | 0.15 |
| Lauryl alcohol (97% pure) | 0.35 |
| Deionized water | to 100% |

This intermediate is then pressurized utilizing 94.5% intermediate and 5.5% isobutane. The formula is tested for flammability by the in-test method described above. Utilizing this test, the above formula is substantially non-flammable.

EXAMPLE 2

The formula of Example 1 is repeated, with the exception that the percentage of lauryl alcohol is raised to 0.45%. When tested for flammability, as in Example 1, this formula is also substantially non-flammable.

EXAMPLE 3

The formula of Example 1 is again repeated with the exception that the lauryl alcohol is increased to 0.55%. This product, when tested in accordance with the above procedure, is substantially non-flammable.

COMPARATIVE EXAMPLES 1 and 2

The formula of Example 1 is repeated, with the exception that the lauryl alcohol content is decreased to 0.15 and 0.25% respectively. These formulas, when tested in accordance with the procedure of Example 1, were found to be flammable in that flame was propagated.

EXAMPLE 4

The formula of Example 1 is utilized, except that the same is pressurized with a blend of propane and isobutane. When tested in accordance with the procedure of Example 1, this composition was found to be substantially non-flammable.

COMPARATIVE EXAMPLES 3–9

The formula of Example 1 is repeated with the exception that lauryl alcohol is replaced with equivalent amounts of the alcohols shown in Table I. The flammability of each of these compounds, when tested in accordance with the procedure of Example 1, is shown:

TABLE I

| Comparative Example | Alcohol | Flammable |
|---|---|---|
| 3 | lauryl alcohol + 9EO* | Yes |
| 4 | decyl alcohol | Yes |
| 5 | mixed—55% lauryl alcohol 45% tetradecanol | Yes |
| 6 | olecyl alcohol + 5EO* | Yes |
| 7 | olecyl alcohol + 20EO* | Yes |
| 8 | isostearyl alcohol | Yes |
| 9 | isostearyl alcohol + 10EO* | Yes |

* - + "N"EO - reacted with "N" moles of ethylene oxide

The above clearly shows that it is lauryl alcohol which provides the flammability reduction in the compositions of the present invention and that even ethoxylating lauryl alcohol or utilizing alcohols other than lauryl alcohol, including mixed lauryl alcohol with other alcohols, if the lauryl alcohol level is reduced below 0.3%, results in a substantially non-flammable system.

EXAMPLES 4–11 AND COMPARATIVE EXAMPLES 10–12

A series of non-pressurized intermediates are prepared wherein the lauryl alcohol, 97% pure, content is varied as shown in Table II:

| | |
|---|---|
| SMA resin (40%) | 12.50% |
| Zinc ammonium citrate (61.2%) | 4.50 |
| Ammonium lauryl sulfate (30%) | 3.86 |
| Lauryl alcohol | X |
| Perfume | 0.15 |
| Sodium benzoate | 0.50 |
| Water | QS to 100 |

These intermediates are pressurized by mixing 90% intermediate with 10% isobutane. The pressurized products are tested using the Tower method, the Trough method and the in-use method described previously. The Trough test results are shown in Table II, while the Tower and in-use tests as well as the overall rating are shown in Table III.

TABLE II

| EXAMPLE | % LAURYL ALCOHOL | TROUGH TEST INITIAL 100% | 80% | 20% | AVE[1] | TROUGH TEST - 2 MIN. 100% | 80% | 20% | AVE | TROUGH TEST - 5 MIN. 100% | 80% | 20% | AVE | TROUGH TEST RANKING 0 = BEST 10 = WORST |
|---|---|---|---|---|---|---|---|---|---|---|---|---|---|---|
| Comp 10 | 0.0 | P[2]11[3]RT[4] | P14SM[5] | P14SM | P13SM | P3 | P14SM | P14RT | P10RT | P14SM | * | * | P14SM | 10 |
| Comp 11 | 0.1 | N | P4 | P14 | P6 | P1 | P14SM | P14SM | P9SM | P2 | * | * | P2 | 9 |
| Comp 12 | 0.2 | N | N | P5 | P2 | P1 | N | P5SM | P2SM | N | P1 | P7SM | P3 | 7 |
| 4 | 0.3 | N | N | N | N | P1 | P1 | N | P1 | N | P14 | P1 | P5 | 5 |
| 5 | 0.4 | N | N | N | N | N | P2 | P2 | P1 | N | P2 | P2 | P1 | 1 |
| 6 | 0.5 | N | N | N | N | N | P8 | P1 | P3 | N | P8 | P1 | P3 | 4 |
| 7 | 0.6 | N | N | N | N | P14 | P14 | N | P9 | P14 | P14 | N | P9 | 8 |
| 8 | 0.7 | N | N | N | N | N | N | N | N | N | P6 | N | P2 | 0 |
| 9 | 0.8 | N | N | N | N | N | N | N | N | P14 | P14 | N | P9 | 6 |
| 10 | 0.9 | N | N | N | N | N | N | N | N | P14 | N | N | P5 | 3 |
| 11 | 1.0 | N | N | N | N | N | N | N | N | N | N | P11 | P4 | 2 |

[1]AVE Average of 100% full, 80% full and 20% full cans.
[2]P Flame propagation
[3]11 11 inches of travel
[4]RT Flame returns, i.e., P11RT - flame propagates 11 inches and returns.
[5]SM Flame sustained on surface. Number shows inches if less than whole trough.
[6]N No flame propagation.
[7]* No residue remains after previous tests.

TABLE III

| EXAMPLE | % LAURYL ALCOHOL | TOWER TEST 100% | 80% | 20% | AVE | TOWER TEST RANKING | IN-USE TEST | COMBINED RANKING |
|---|---|---|---|---|---|---|---|---|
| Comp 10 | 0.0 | 5[1] | 5 | 4 | 5 | 10 | S[3]–HF[4] | 10 |
| Comp 11 | 0.1 | 3 | 4 | 4 | 4 | 9 | S–HF | 9 |
| Comp 12 | 0.2 | 2 | 1 | 2 | 2 | 8 | S | 8 |
| 4 | 0.3 | N | 1 | 1 | 1 | 4 | F | 7 |
| 5 | 0.4 | N | N | 1 | N | 1 | N | 0 |
| 6 | 0.5 | N | N | 1 | N | 1 | N | 3 |
| 7 | 0.6 | 1 | N | 1 | 1 | 4 | N | 6 |
| 8 | 0.7 | 1 | 1 | 1 | 1 | 6 | N | 4 |
| 9 | 0.8 | 1 | 1 | 1 | 1 | 6 | N | 5 |
| 10 | 0.9 | N | N | N | N | 0 | N | 2 |
| 11 | 1.0 | N | 1 | N | N | 1 | N | 1 |

[1]a number indicates a positive flash. The number is the hole number, i.e., 15 = top, 1 - bottom.
[2]N - negative test
[3]S - sustains flame
[4] HF - hot flame
[5]limited flash
[6] trough test, tower test and in-use test

EXAMPLE 12

Example 1 is repeated except that the ammonium lauryl sulfate is replaced with magnesium lauryl sulfate on an equal solids basis. This formulation is substantially less flammable than a similar formula without the lauryl alcohol when tested as in Example 1.

EXAMPLE 13

Example 1 is repeated except that the ammonium lauryl sulfate is replaced with diethanolamine lauryl sulfate on an equal solids basis. This formulation is substantially less flammable than a similar formula without the lauryl alcohol when tested as in Example 1.

EXAMPLE 14

Example 1 is repeated except that the ammonium lauryl sulfate is replaced with triethanolamine lauryl sulfate on an equal solids basis. This formulation is substantially less flammable than a similar formula without the lauryl alcohol when tested as in Example 1.

COMPARATIVE EXAMPLES 13–13

A series of compositions were prepared having the following formulation to determine how other series of alcohols and surfactants retain flammability:

| | |
|---|---|
| SMA Resin (40%) | 12.50 |
| Zn Ammonium carbonate | 4.50 |
| Surfactant | 3.86 |
| Alcohol | 0.35 |
| Perfume | 0.15 |
| Sodium Benzoate | 0.50 |
| Water | QS to 100 |

The formulas were pressurized with 90% intermediate and 10% isobutane. The specific surfactants and alcohols are shown in Table IV as well as the results of the in-use Flammability Test.

TABLE IV

| COMPARATIVE EXAMPLE | SURFACTANT | ALCOHOL | FLAMMABLE |
|---|---|---|---|
| 13 | Sodium octyl sulfate | Octyl alcohol | Yes |
| 14 | Sodium octyl sulfate | Lauryl alcohol | Yes |
| 15 | Sodium oleyl sulfate | Oleyl alcohol | Yes |
| 16 | Sodium oleyl sulfate | Lauryl alcohol | Yes |
| 17 | Sodium tridecyl sulfate | Tridecyl alcohol | Yes |
| 18 | Sodium tridecyl sulfate | Lauryl alcohol | Yes |

These tests show that both a lauryl alcohol and a lauryl sulfate are necessary to retard flammability and that other matched carbon chain sulfates and alcohol do not retard flammability.

EXAMPLES 15–17 AND COMPARATIVE EXAMPLES 19–23

To show the effect of variation of the lauryl sulfate and lauryl alcohol content the following compositions were prepared:

| | |
|---|---|
| SMA Resin (40%) | 12.50 |
| Zn ammonium carbonate | 4.50 |
| Ammonium lauryl sulfate (30%) | X |
| Lauryl Alcohol | Y |
| Sodium benzoate | 0.50 |
| Perfume | 0.15 |

-continued

| | |
|---|---|
| Water | QS to 100 |

The above intermediates were pressurized by mixing 90% intermediate with 10% isobutane. The various formulations and the flammability results of the in-use test are shown in Table V.

TABLE V

| EXAMPLE | LAURYL ALCOHOL(Y) | AMMONIUM LAURYL SULFATE(X) | FLAMMABLE |
|---|---|---|---|
| Comp Ex 19 | 0.35 | 1.93 | Yes |
| Comp Ex 20 | 0.35 | 2.89 | Yes |
| Comp Ex 21 | 0.15 | 3.86 | Yes |
| Comp Ex 22 | 0.15 | 5.78 | Yes |
| Comp Ex 23 | 0.15 | 7.72 | Yes |
| 15 | 0.35 | 3.86 | No |
| 16 | 0.35 | 5.78 | No |
| 17 | 0.35 | 7.72 | No |

The above results show the criticality of both the alcohol and sulfate content.

EXAMPLES 18–19 AND COMPARATIVE EXAMPLES 24–6

A series of carpet care products are formulated having the following composition wherein the amount of lauryl alcohol is varied as shown in Table VI.

| | |
|---|---|
| SMA Resin (40%) | 12.50 |
| Zinc Ammonium Carbonate | 4.50 |
| Condonol CS (30% 1:2 Sodium Lauryl sulfate: Sodium Lauryl sulfosuccinate) | 3.86 |
| Preservative | 0.70 |
| Perfume | 0.15 |
| Lauryl alcohol | Varies |
| Water | QS to 100 |

The above intermediates are pressurized using 10% isobutane and tested using the in-use test.

TABLE VI

| EXAMPLE | LAURYL ALCOHOL | FLAMMABLE |
|---|---|---|
| Comp Ex 24 | 0.15 | Yes |
| Comp Ex 25 | 0.25 | Yes |
| Comp Ex 26 | 0.35 | Marginal |
| 18 | 0.45 | No |
| 19 | 0.55 | No |

It is apparent that substantially nonflammable systems can be produced using lower levels of sodium lauryl sulfate if mixed with sodium lauryl sulfosuccinates.

EXAMPLES 20–31 AND COMPARATIVE EXAMPLES 27–32

As series of carpet care products are formulated using the following intermediate compositions:

| | |
|---|---|
| SMA Resin (40%) | 12.50 |
| Zinc Ammonium Carbonate | 4.50 |
| Ammonium Lauryl Sulfate | 3.86 |
| Preservative | 0.70 |
| Lauryl Alcohol | Varies (Table VII) |
| Perfume | 0.15 |
| Water | QS to 100 |

TABLE VII

| EXAMPLE | LAURYL ALCOHOL (%) | PROPELLENT COMPOSITION | FLAMMABILITY RATING* |
|---|---|---|---|
| Comp Ex 27 | 0 | 80% isobutane, 20% propane | 10 |
| Comp Ex 28 | 0 | 100% isobutane (10%) | 10 |
| Comp Ex 29 | 0 | 100% isobutane (9%) | 10 |
| Comp Ex 30 | 0 | 100% n-butane | 10 |
| Comp Ex 31 | 0 | 50% isobutane, 50% n-butane | 10 |
| Comp Ex 32 | 0 | 80% isobutane, 20% isopentane | 10 |
| 20 | 0.35 | 80% isobutane, 20% propane | 1 |
| 21 | 0.35 | 100% isobutane (10%) | 7 |
| 22 | 0.35 | 100% isobutane (9%) | 1 |
| 23 | 0.35 | 100% n-butane | 8 |
| 24 | 0.35 | 50% isobutane, 50% n-butane | 6 |
| 25 | 0.35 | 80% isobutane, 20% isopentane | 4 |
| 26 | 0.55 | 80% isobutane, 20% propane | 5 |
| 27 | 0.55 | 100% isobutane (10%) | 2 |
| 28 | 0.55 | 100% isobutane (9%) | 2 |
| 29 | 0.55 | 100% n-butane | 8 |
| 30 | 0.55 | 50% isobutane, 50% n-butane | 5 |
| 31 | 0.55 | 80% isobutane, 20% isopentane | 4 |

*Flammability Rating
1 = least flammable
10 = most flammable
In each of Examples 20–31 the flammability is reduced from the same composition not containing lauryl alcohol.

The foregoing examples are for illustration only and should not be construed as limiting the present invention which is defined by the following appended claims.

We claim:

1. In a rug cleaning composition of the type comprising:
   a. from 2 to 20% by weight of a rug cleaning polymer;
   b. from 0 to 5% by weight of a metal salt;
   c. from 0.5 to 10% by weight of at least one surfactant
   from 50 to 95% by weight water, and
   e. from 5 to 20% by weight hydrocarbon propellent;
   the improvement which comprises reducing the flammability of said composition by incorporating at least 0.3% by weight lauryl alcohol and wherein said surfactant includes from 0.3 to 10% by weight of the composition of $CH_3(CH_2)_{10}CH_2OSO_3M$ is a positively charged cation.

2. The composition of claim 1 wherein M is selected from sodium, potassium, lithium, magnesium, ammonium, monoethanolamine, diethanolamine and triethanolamine.

3. The composition of claim 2 wherein the lauryl alcohol is present in amounts ranging from about 0.3 to 5% by weight.

4. The composition of claim 3 wherein said range is from about 0.4 to 2% by weight.

5. The composition of claim 4 wherein M is selected from sodium, potassium, lithium, magensium, ammonium, monoethanolamine, diethanolamine and triethanolamine.

6. The composition of claim 4 which comprises:
   a. from 2 to 10% by weight of said polymer;
   b. from 0.5 to 3% by weight of said salt;
   c. from 1 to 5% by weight of a surfactant; said surfactant including from 0.5% to 3% by weight of the composition of $CH_3(CH_2)_{10}CH_2OSO_3M$ wherein M is a cation;
   d. from 67 to 95% by weight of water;
   e. from 5 to 10% by weight of said propellent selected from isobutane, normal butane, propane and mixtures thereof; and
   f. from 0.3 to 5% by weight of lauryl alcohol.

7. The composition of claim 6 wherein said salt is selected from zinc ammonium carbonate, zinc ammonium citrate, zinc ammonium acetate, zirconium ammonium carbonate and aluminum ammonium carbonate.

8. The composition of claim 4 wherein said polymer is styrene maleic anhydride resin.

9. The composition of claim 2 wherein M is selected from sodium, magnesium and ammonium and the percentage of $CH_3(CH_2)_{10}CH_2OSO_3M$ to total surfactant content is from 30% to 100% by weight.

10. The composition of claim 9 wherein the percentage is from 50% to 100% by weight.

11. The composition of claim 9 wherein said surfactant includes 0.5 to 3% by weight of composition $CH_2(CH_2)_{10}CH_2OSO_3M$.

12. The composition of claim 1 which comprises:
   a. from 2 to 10% by weight of said polymer;
   b. from 0.5 to 3% by weight of said salt;
   c. from 1 to 5% by weight of a surfactant; said surfactant including from 0.5% to 3% by weight of the composition of $CH_3(CH_2)_{10}CH_2OSO_3M$ wherein M is a cation;
   d. from 67 to 95% by weight of water;
   e. from 5 to 10% by weight of said propellent selected from isobutane, normal butane, propane and mixtures thereof; and
   f. from 0.3 to 5% by weight of lauryl alcohol.

13. The composition of claim 12 wherein M is selected from sodium, magnesium and ammonium and the percentage of $CH_3(CH_2)_{10}CH_2OSO_3M$ to total surfactant content is from 50% to 100% by weight.

* * * * *

UNITED STATES PATENT OFFICE
CERTIFICATE OF CORRECTION

Patent No. 4,013,595 Dated March 22, 1977

Inventor(s) Carl Walter Podella and Fred Jay Reichley

It is certified that error appears in the above-identified patent and that said Letters Patent are hereby corrected as shown below:

Column 1, line 48, after "alcohols" insert a comma.

Column 2, line 58, after "those" insert --disclosed--.

Column 5, line 13, after "is" insert --the--.

Table II, line 9, after "*" insert --7--.
Table II, line 10, after "N" insert --6--.

Table III, line 4, after "RANKING" insert --6--.
Table III, line 8, after "N" insert --2--.
Table III, line 8, after "F" insert --5--.

Column 7, line 24, delete "13-13" and insert --13-18--.
Column 7, line 27, delete "series" and insert --pairs--.

Claim 1, line 6, insert a semi-colon after "tant".
Claim 1, line 7, insert --d.-- before "from".

Claim 11, line 3, delete the first "$CH_2$" and insert --$CH_3$--.

Signed and Sealed this

Thirty-first Day of May 1977

[SEAL]

*Attest:*

RUTH C. MASON
*Attesting Officer*

C. MARSHALL DANN
*Commissioner of Patents and Trademarks*